US005771696A

United States Patent [19]

Hansel et al.

[11] Patent Number: 5,771,696

[45] Date of Patent: Jun. 30, 1998

[54] INTERNAL MANIFOLD FUEL INJECTION ASSEMBLY FOR GAS TURBINE

[75] Inventors: Harold R. Hansel, Mason; George E. Cook, Cincinnati, both of Ohio

[73] Assignee: General Electric Company, Cincinnati, Ohio

[21] Appl. No.: 734,164

[22] Filed: Oct. 21, 1996

[51] Int. Cl.[6] ..... F02C 7/22

[52] U.S. Cl. ..... 60/739; 60/746

[58] Field of Search ..... 60/39.31, 39.32, 60/39.36, 734, 739, 746

[56] References Cited

U.S. PATENT DOCUMENTS

| | | | |
|---|---|---|---|
| 2,526,410 | 10/1950 | Price | 60/739 |
| 2,676,461 | 4/1954 | Gove | 60/739 |
| 2,686,401 | 8/1954 | Newcomb | 60/739 |
| 3,516,252 | 6/1970 | Udell et al. | 60/739 |
| 3,643,430 | 2/1972 | Emory, Jr. et al. | 60/39.65 |
| 3,879,940 | 4/1975 | Stenger et al. | 60/39.74 |
| 4,305,255 | 12/1981 | Davies et al. | 60/741 |
| 4,441,323 | 4/1984 | Colley | 60/737 |
| 4,467,610 | 8/1984 | Pearson et al. | 60/739 |
| 5,316,346 | 5/1994 | Maurer | 285/23 |

*Primary Examiner*—Louis J. Casaregola

*Attorney, Agent, or Firm*—Andrew C. Hess; Patrick R. Scanlon

[57] ABSTRACT

A gas turbine engine fuel injection assembly includes a combustor case surrounding a combustor having a dome. An arcuate manifold is disposed inside the combustor case adjacent to the dome, and includes a plurality of fuel injectors disposed in flow communication therewith for receiving fuel for injection into the combustor. An inlet stem is joined in flow communication with the manifold for channeling fuel thereto, and includes an inner fitting disposed in a mounting port in the combustor case. A mounting adaptor is joined to the combustor case at the mounting port, and circumferentially engages the inner fitting to restrain torsional movement thereof. An outer fitting extends in the adaptor and engages the inner fitting in flow communication therewith for supplying fuel thereto.

10 Claims, 5 Drawing Sheets

INTERNAL MANIFOLD FUEL INJECTION ASSEMBLY FOR GAS TURBINE

BACKGROUND OF THE INVENTION

The present invention relates generally to gas turbine engines, and, more specifically, to fuel systems therefor.

A turbofan gas turbine engine includes in serial flow communication a fan, compressor, combustor, high pressure turbine powering the compressor, and a low pressure turbine powering the fan. When used with an augmenter or afterburner following the low pressure turbine, the engine also includes an annular fan bypass duct which channels a portion of the fan air downstream over the combustor and to the afterburner for providing cooling air thereto.

The bypass duct is defined by an annular radially outer casing and an annular combustor case spaced radially inwardly therefrom. The combustor case surrounds the annular combustor and is suitably joined at its upstream end to a diffuser mounted at the discharge end of the compressor. The diffuser receives high pressure discharge air which is fed to a fuel injection assembly for mixing with fuel and being burned in the combustor for generating hot combustion gases. The compressor discharge air surrounding the combustor is bounded by the combustor case which is suitably sealed for preventing leakage of the high pressure air into the fan air channeled through the bypass duct which is at a substantially lower pressure, on the order of several hundred psi lower.

Typical fuel injectors have long stems, with a mounting flange at the radially outer end, and a fuel injector or tip at the radially inner end. The injector is disposed in a corresponding air swirler mounted to the upstream or dome end of the combustor. The mounting flange is sealingly bolted to the combustor case through a corresponding port therefor to prevent leakage of the high pressure compressor discharge air from the combustor case and into the fan bypass duct.

In a typical annular combustor, there are a substantial number of individual fuel injectors and corresponding stems mounted into corresponding air swirlers. In a double dome combustor, two annular rows of fuel injectors and corresponding air swirlers are used which increases the number thereof. Each individual fuel injector and air swirler must be accurately located in the combustor dome to maximize combustion efficiency for obtaining acceptable specific fuel consumption (SFC) and exhaust emissions. Both SFC, and in particular NOx emissions may be decreased by increasing the number of fuel injection locations to more uniformly inject and mix the fuel and air into the combustor for combustion.

However, increasing the number of fuel injectors correspondingly increases the difficulty of accurately positioning each fuel injector in the combustor dome. And, more complex shapes of the fuel stems such as S-shaped stems, which must be assembled through the combustor case also increases the difficulty of accurately positioning the fuel injectors in the combustor dome.

Since each fuel injector and stem are individually manufactured, they are subject to typical manufacturing tolerances which vary randomly from injector to injector by several mils for example. Since each fuel injector is relatively long from its mounting flange to its injector tip, it is difficult to accurately manufacture and assemble the individual fuel injectors for maintaining accurate final positions thereof in the combustor. Accordingly, further improvements in SFC and NOx are still possible by providing further improvements in fuel injector mounting design.

SUMMARY OF THE INVENTION

A gas turbine engine fuel injection assembly includes a combustor case surrounding a combustor having a dome. An arcuate manifold is disposed inside the combustor case adjacent to the dome, and includes a plurality of fuel injectors disposed in flow communication therewith for receiving fuel for injection into the combustor. An inlet stem is joined in flow communication with the manifold for channeling fuel thereto, and includes an inner fitting disposed in a mounting port in the combustor case. A mounting adaptor is joined to the combustor case at the mounting port, and circumferentially engages the inner fitting to restrain torsional movement thereof. An outer fitting extends in the adaptor and engages the inner fitting in flow communication therewith for supplying fuel thereto.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
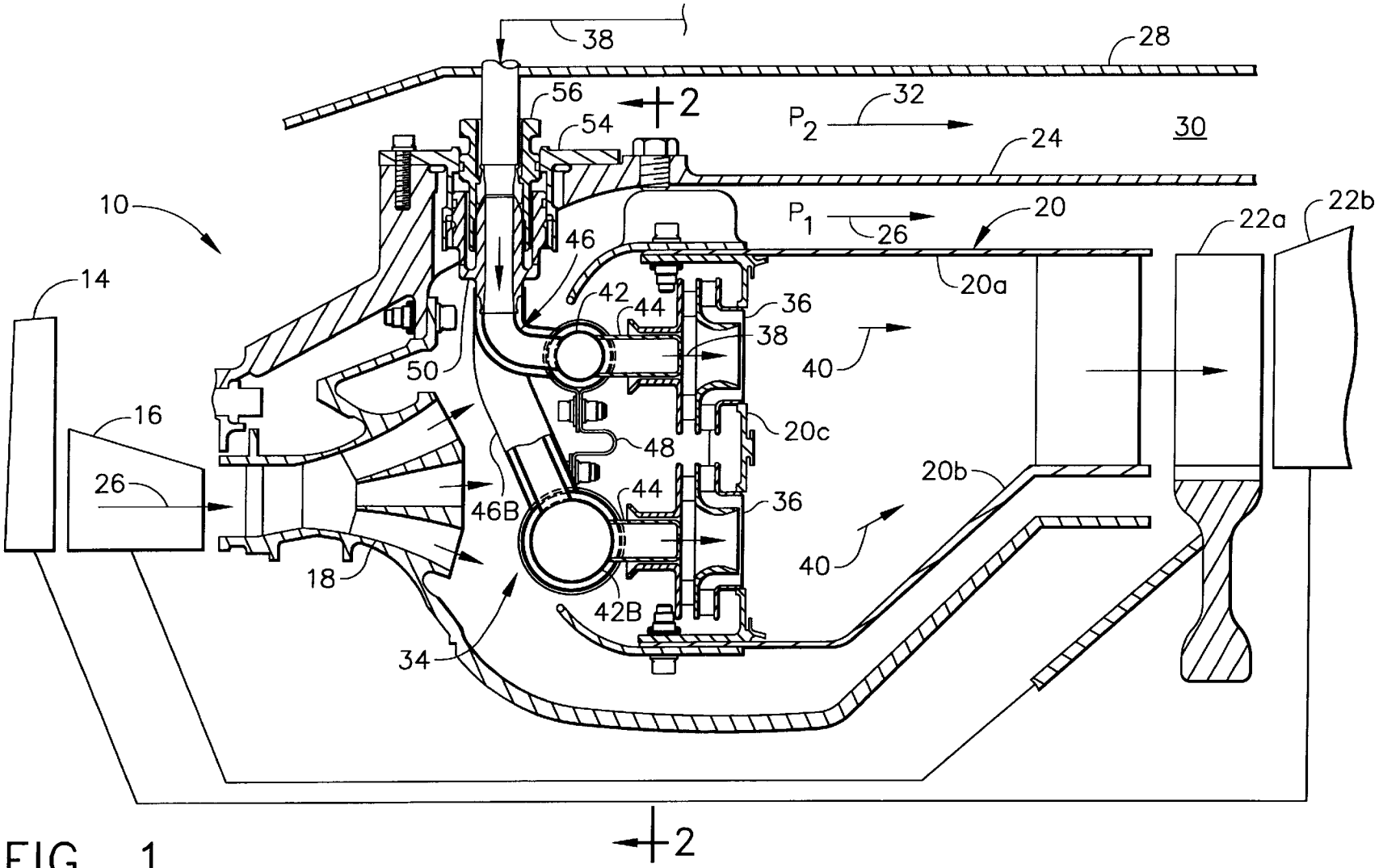
FIG. 1 is a schematic, partly sectional axial view of an exemplary turbofan gas turbine engine including a fuel injection assembly in accordance with one embodiment of the present invention for providing fuel to a combustor therein.

Illustrated schematically in FIG. 1 is a portion of an exemplary turbofan gas turbine engine 10 which is axisymmetrical about an axial or longitudinal centerline axis 12. The engine includes in serial flow communication a fan 14, a compressor 16, diffuser 18, combustor 20, high pressure turbine 22*a* which powers the compressor 16 through a corresponding drive shaft, and a low pressure turbine 22*b* which powers the fan 14 through a corresponding drive shaft.

An annular combustor casing or case 24 surrounds the combustor 20 and diffuser 18 and receives pressurized discharge air 26 from the diffuser 18. The combustor case 24 is spaced radially inwardly from annular outer casing 28 and defines therebetween an annular bypass duct 30 which extends from the fan 14 for receiving a portion of the fan air 32 and channeling it downstream past the combustor 20 to a conventional augmenter or afterburner (not shown).

These components of the engine 10 are conventional in structure and function. In accordance with one embodiment of the present invention, a fuel injection assembly 34 is incorporated in the engine 10 for more accurately injecting fuel into the combustor 20 for decreasing both SFC and NOx emissions.

More specifically, the combustor 20 includes radially outer and inner annular liners 20*a* and 20*b* joined together at upstream ends thereof to a conventional annular dome 20*c*. The combustor 20 may take any conventional form including the double dome combustor illustrated in FIG. 1, or a single dome combustor (not shown). In the exemplary double dome embodiment illustrated, two annular rows of circumferentially spaced apart conventional air swirlers 36 are suitably mounted to the dome 20*c* axisymmetrically around the engine centerline axis 12. Each of the swirlers 36 includes respective rows of stator vanes which swirl the compressed air 26 into the combustor 20 in a conventional manner. The fuel injection assembly 34 provides fuel 38 through individual ones of the swirlers 36 which is mixed with the compressed air and suitably ignited for generating hot combustion gases 40 which flow downstream through the combustor 20 and in turn through the turbines 22*a, b* for powering the compressor 16 and fan 14, respectively.

In accordance with the present invention, the fuel injection assembly 34 includes the upstream portion of the combustor case 24, with the annular combustor 20 being disposed coaxially therein, with the combustor dome 20*c* being spaced axially downstream from the diffuser 18 at the upstream end of the combustor case 24. An arcuate, first or radially outer fuel manifold 42 is disposed inside the combustor case 24 adjacent to the combustor dome 20*c* and includes a plurality of circumferentially spaced apart, axially extending fuel injectors or tips 44 disposed in flow communication with the manifold 40 for receiving the fuel 38 therefrom for injection through the dome 20*c* and the swirlers 36 for producing a suitable fuel and air mixture for combustion in the combustor 20.

At least one, and preferably a plurality of inlet stems 46 are disposed in flow communication with the manifold 42 for channeling fuel thereto. As additionally shown in FIG. 2, a substantially identical second or radially inner manifold designated 42B is disposed coaxially with the first manifold 42 and is supplied with fuel through corresponding inlet stems designated 46B. The first manifold 42 and injectors 44 thereof supply fuel to the outer swirlers 36, while the second manifold 42B and fuel injectors 44 thereof supply fuel to the radially inner swirlers 36. Accordingly, the two manifolds 42, 42B may be substantially identical in structure and function, with suitable configurations for supplying fuel to the outer and inner swirlers 36.

Although the inner manifold 42B may be independently mounted like the first manifold 42, in the preferred embodiment illustrated in FIG. 1 it is suspended from the first manifold 42 by suitable radial straps 48 extending therebetween. Since the manifold arrangements are substantially identical in structure and function, the following description is specific to the first manifold 42, with it being understood that the second manifold 42B and its cooperating components may be identically configured.

Figure 3:
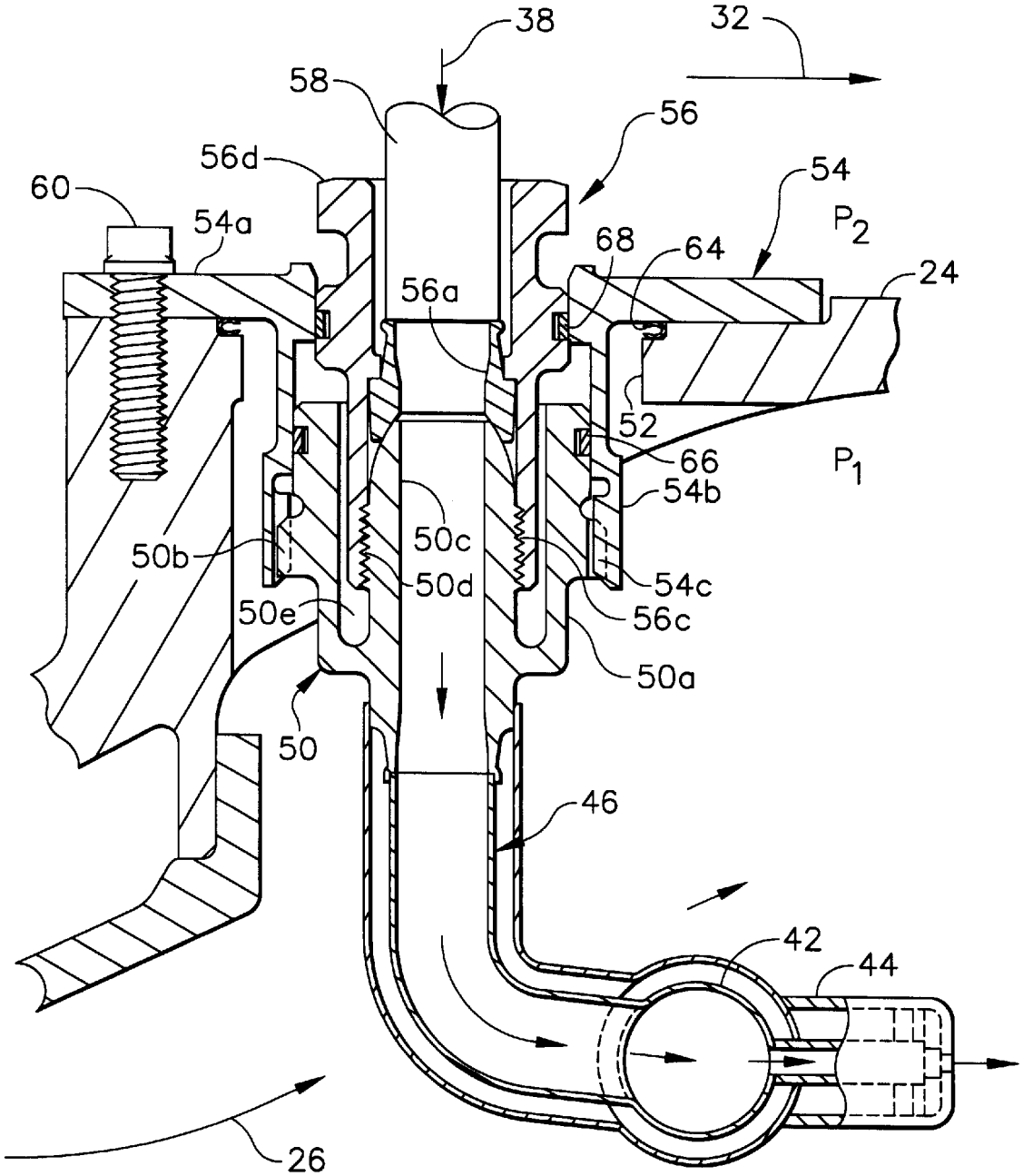
FIG. 3 is an enlarged, axial sectional view of a portion of the fuel injection assembly illustrated in FIG. 2 and taken along line 3—3 showing an exemplary fuel inlet stem extending from a combustor case to an arcuate fuel manifold.

The manifold 42 and cooperating stem 46 are illustrated in more particularity in FIG. 3 in accordance with an exemplary embodiment of the present invention. The manifold 42 and stem 46 may have any suitable double-wall design for carrying fuel through the center thereof and providing an insulating dead air space between the inner and outer walls for providing heat insulation in a conventional manner. The outer walls of the manifold 42 and stem 46 therefore define heat shields surrounding the inner walls which carry the fuel. The individual fuel injectors 44 may take any conventional configuration and are suitably joined in flow communication with the manifold 42 for receiving the fuel 38 therefrom and injecting the fuel through respective ones of the swirlers 36 illustrated in FIG. 1.

Figure 2:
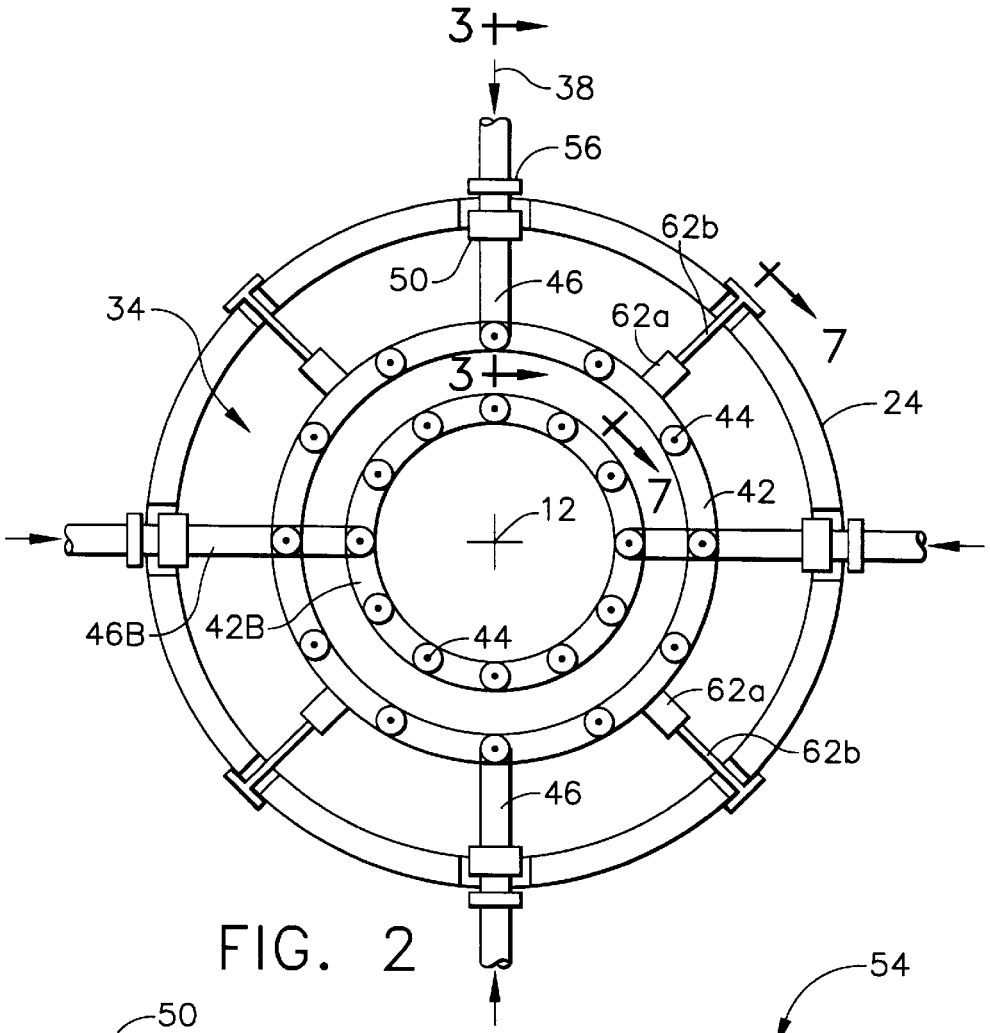
FIG. 2 is a radial, upstream facing view of the fuel injection assembly illustrated in FIG. 1 and taken generally along line 2—2.

The manifold 42 is arcuate since it extends circumferentially around the centerline axis 12 of the engine as illustrated in FIG. 2, and in the preferred embodiment is a continuous annular member. It may be formed of suitable segments brazed or welded together to form the complete ring. Although a single one of the fuel stems 46 may be used for channeling the fuel 38 into the manifold 42, preferably two fuel stems 46 disposed about 180 degrees apart are provided to channel fuel into the manifold 42 at two circumferential locations from which it is circumferentially distributed around the manifold 42 into all of the fuel injectors 44 attached thereto around its circumference.

By mounting the manifold 42 internal to the combustor case 24 and directly adjacent to the combustor dome 20*c*, the individual fuel injectors 44 may be made relatively short in length and relatively simple in configuration for substantially improving the accuracy of position of the individual fuel injectors 44 in their respective air swirlers 36. The annular manifold 42 provides a common reference support from which the individual fuel injectors 44 are fixedly attached, and therefore the individual relatively short fuel injectors 44 may be more accurately positioned in space relative to each other and in turn relative to the combustor 20. As opposed to conventional individually mounted fuel injectors and corresponding fuel stems, the common manifold 42 and attached fuel injectors 44 provides substantially improved positional accuracy for decreasing SFC and NOx emissions during operation.

However, since the manifold 42 is now positioned inside the combustor case 24 adjacent to the upstream end of the dome 20*c*, and is in the preferred form of a continuous ring, it requires special mounting to the combustor case 24 to avoid or reduce undesirable reaction stress therein during assembly, and preventing the undesirable leakage of the high pressure compressor discharge air 26 from the combustor case 24 into the lower pressure fan bypass duct 30 during operation. As indicated above, the differential pressure between the inside of the combustor case 24 and the outside thereof in the bypass duct 30 may be several hundred psi requiring effective sealing for channeling the fuel through the combustor case 24.

More specifically, and referring again to FIG. 3, the inlet stem 46 is suitably fixedly joined at its distal end to the manifold 42 in flow communication therewith, and includes a first, radially inner fuel fitting 50 at its proximal end disposed at a suitable mounting port 52 extending radially through the combustor case 24.

A tubular mounting adaptor 54 is suitably fixedly joined to the combustor case 24 at the mounting port 52, and circumferentially engages the inner fitting 50 in accordance with the present invention to restrain torsional movement thereof. In the preferred embodiment, the manifold 42 and its attached stems 46 is assembled or positioned inside the combustor case 24 and is not accessible from outside the combustor case 24 during the assembly process. Accordingly, the inlet stem 46 is hidden below the mounting port 52 and cannot be temporarily secured by a conventional wrench for completing the fuel connection thereto. The mounting adaptor 54 engages the inner fitting 50 as described in more detail hereinbelow so that a suitable radially outer or second fuel fitting 56 may be sealingly attached to the inner fitting 50 in flow communication therewith for supplying fuel thereto. The outer fitting 56 is suitably joined to fuel supply conduit 58 which supplies fuel from a suitable fuel supply (not shown) in the engine 10.

In order to allow the outer fitting 56 to be torsionally threaded to the inner fitting 50 without damaging the inaccessible fuel stem 46, the mounting adaptor 54 is suitably splined to the inner fitting 50 to restrain or react torsional loading as the outer fitting 56 is tightened. The inner fitting 50 as shown in FIG. 3 preferably includes a tubular shroud 50*a* having a plurality of circumferentially spaced apart axially extending splines 50*b*. The splines 50*b* are preferably disposed at the bottom end of the inner fitting shroud 50*a* on its external surface and are axial relative to the fitting 50 itself, and extend radially relative to the engine centerline axis 12.

The adaptor 54 includes a tubular mounting hub or flange 54*a* which is fixedly joined to the combustor case 24 by a plurality of circumferentially spaced apart fasteners in the form of machine screws 60. The adaptor 54 also includes an integral tubular sleeve 54*b* fixedly joined to the flange 54*a* at the inner diameter thereof, and extends radially inwardly through the mounting port 52. The sleeve 54*b* coaxially surrounds the complementary shroud 50*a,* and includes a plurality of circumferentially spaced apart axial splines 54*c* spaced circumferentially therearound. The sleeve splines 54*c* extend axially relative to the sleeve 54*b* itself, and radially relative to the centerline axis of the engine. The sleeve splines 54*c* are complementary with the shroud splines 50*b* for engagement therewith to restrain torsional movement of the shroud 50*a* and in turn the inner fitting 50.

Figure 4:
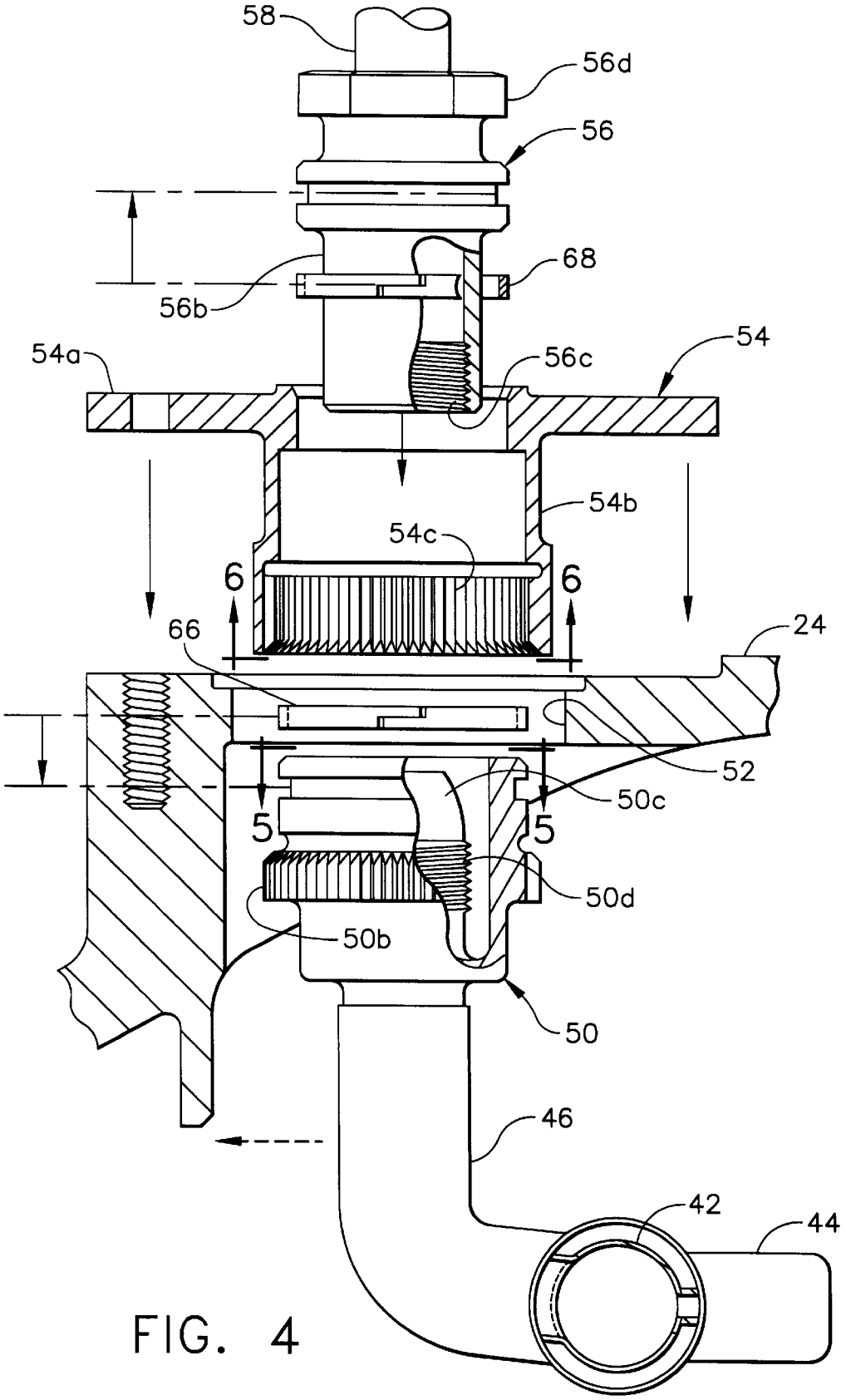
FIG. 4 is an exploded view of exemplary elements of the fuel injection assembly illustrated in FIG. 3 showing assembly thereof to the combustor case.

The assembly of the manifold 42 and attached fuel stems 46 with corresponding inner fittings 50 to the combustor case 24 is illustrated in exploded view in FIG. 4. Since the manifold 42 is a full ring, it is translated axially forwardly inside the empty combustor case 24 into position under the corresponding mounting ports 52 which are radially aligned with the two corresponding inner fittings 50. The mounting adapters 54 are inserted radially inwardly through their respective mounting ports 52 so that the cooperating splines 50*b* and 54*c* engage each other.

Figure 5:
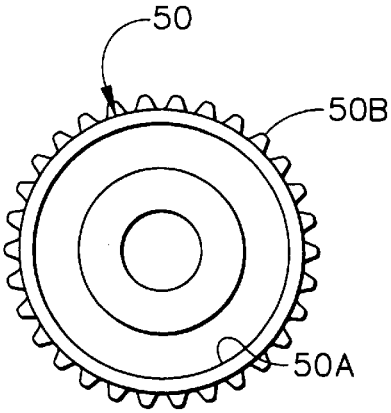
FIG. 5 is a radially inwardly facing top view of the mounting end of the fuel inlet stem illustrated in FIG. 4 and taken generally along line 5—5.
Figure 6:
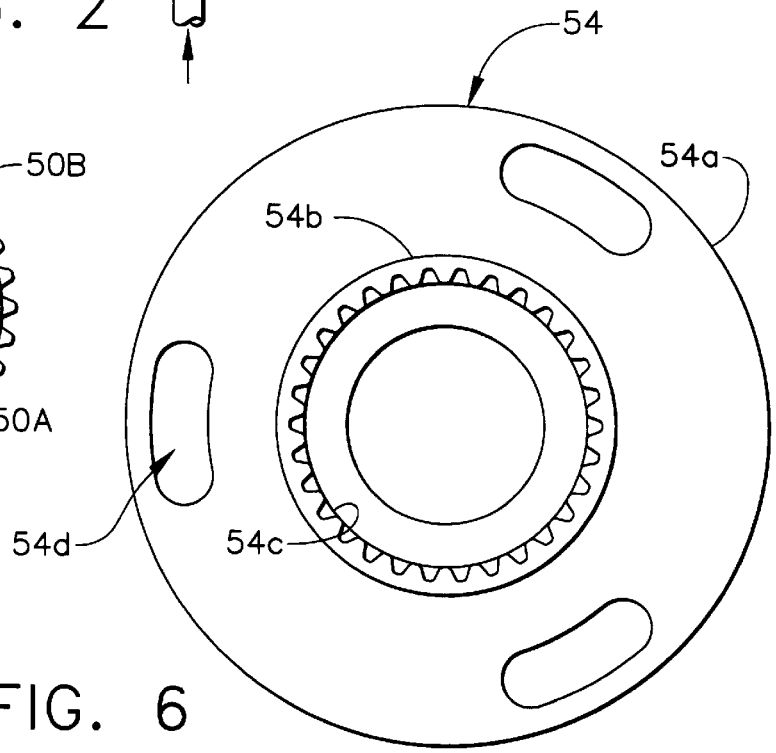
FIG. 6 is a radially outwardly facing view of a mounting adaptor disposed between the inner fitting and a cooperating outer fitting illustrated in FIG. 4 and taken generally along line 6—6.

The shroud splines 50*b* are disposed on the external surface of the shroud 50*a* as illustrated FIG. 4, and in more particularity in FIG. 5. The sleeve splines 54*c* are preferably internal splines at the bottom end of the adaptor 54 as illustrated in FIG. 4, and in more particularity in FIG. 6. Also shown in FIG. 6 are three exemplary arcuate slots 54*d* through which the fasteners 60 extend for fixedly mounting the adaptor 54 to the combustor case 24 as illustrated in FIG. 3. The slots 54*d* allow the adaptor 54 to be aligned over the corresponding inner fitting 50 so that the respective sleeve splines 54*c* engage the shroud splines 50*b*. The slots 54*d* have suitable circumferential extent so that the corresponding fasteners 60 may be inserted therethrough without requiring rotational movement of the adaptor 54. In this way, the adaptor 54 may be fixedly attached to the combustor case 24 without imposing any torsional load or twist on the individual inlet stems 46.

With the mounting adaptor 54 thusly engaging the inner fitting 50, the outer fitting 56 may then be radially inserted downwardly through the adaptor 54 to threadingly engage the inner fitting 50 to provide a sealed joint thereat. More specifically, and referring to FIG. 3, the outer fitting 56 in this exemplary embodiment includes a tubular ferrule 56*a* suitably fixedly joined to the supply conduit 58 by brazing or welding thereto for example. The inner fitting 50 includes a complementary ballnose 50*c* which sealingly engages the outer fitting 56 at the ferrule 56*a* for channeling fuel into the inlet stem 46. The ferrule 56*a* defines an outlet of the supply conduit 58, with the ballnose 50*c* defining an inlet to the stem 46, and may have any conventional engagement surfaces for effecting a suitable fluid seal thereat upon tightening of the outer fitting 56 to the inner fitting 50.

The outer fitting 56 also includes a cooperating threaded collar 56*b* which extends radially inwardly into the inner fitting 50. The collar 56*b* preferably includes internal threads 56*c* at its bottom end, and the ballnose 50*c* preferably includes complementary external threads 50*d* engaging the collar internal threads 56*c* for torsionally or threadingly joining together the outer and inner fittings 56, 50.

The tubular shroud 50*a* illustrated in FIG. 3 is preferably fixedly joined at its bottom end to the ballnose 50*c* and spaced radially outwardly therefrom to define an annular slot 50*e* therearound for receiving the collar portion 56*b* of the outer fitting 56.

As shown in FIG. 3, the collar 56*b* extends coaxially from an integral nut 56*d* upon which a conventional wrench may engage for turning the outer fitting 56 to threadingly engage the inner fitting 50 in a conventional manner. The outer fitting 56 is generally in the form of a conventional B-nut suitably modified for the present invention. The nut 56*d* surrounds the ferrule 56*a* in a conventional manner so that it may be rotated around the centerline axis of the ferrule 56*a* as the threads engage to correspondingly sealingly engage the ferrule 56*a* with the ballnose 50*c* and provide a fluid-tight seal thereat. Torsional reaction loads from the outer fitting 56 are carried through the splines 50*b* and 54*c* into the mounting adaptor 54 and in turn into the combustor case 24. In this way, torsion applied to the nut 56*d* does not twist the relatively fragile inlet stem 46 itself, with the adaptor 54 providing a convenient element for torsionally restraining the inner fitting 50 without requiring internal access by an assembly technician within the combustor case 24 therefor.

Furthermore, the mounting adaptor 54 permits unrestrained differential radial movement between the inner fitting 50 and the adaptor 54 itself during operation to reduce undesirable thermal stresses in these components. Different operating temperatures through the regions of the fuel injection assembly cause the different components thereof to heat and cool at different rates and undergo differential thermal expansion and contraction. The shroud splines 50*b* engage the sleeve splines 54*c* to prevent torsional movement therebetween while allowing relative axial movement along the splines themselves, which in the FIG. 3 embodiment is directed in the radial direction relative to the centerline axis of the engine. In this way, as the ring manifold 42 expands and contracts relative to the combustor case 24, the attached inlet stems 46 move radially therewith, with the splines allowing unrestrained differential radial movement to thereby reduce thermal stresses which would otherwise be provided if the outer fittings 50 were radially attached or restrained by the combustor case 24.

Furthermore, the outer fitting 56 preferably extends through the centerbore of the adaptor 54 and is carried with the inner fitting 50 to which it is attached. The outer fitting 56 is not separately attached to the adaptor 54 for allowing unrestrained differential radial movement therebetween.

Figure 7:
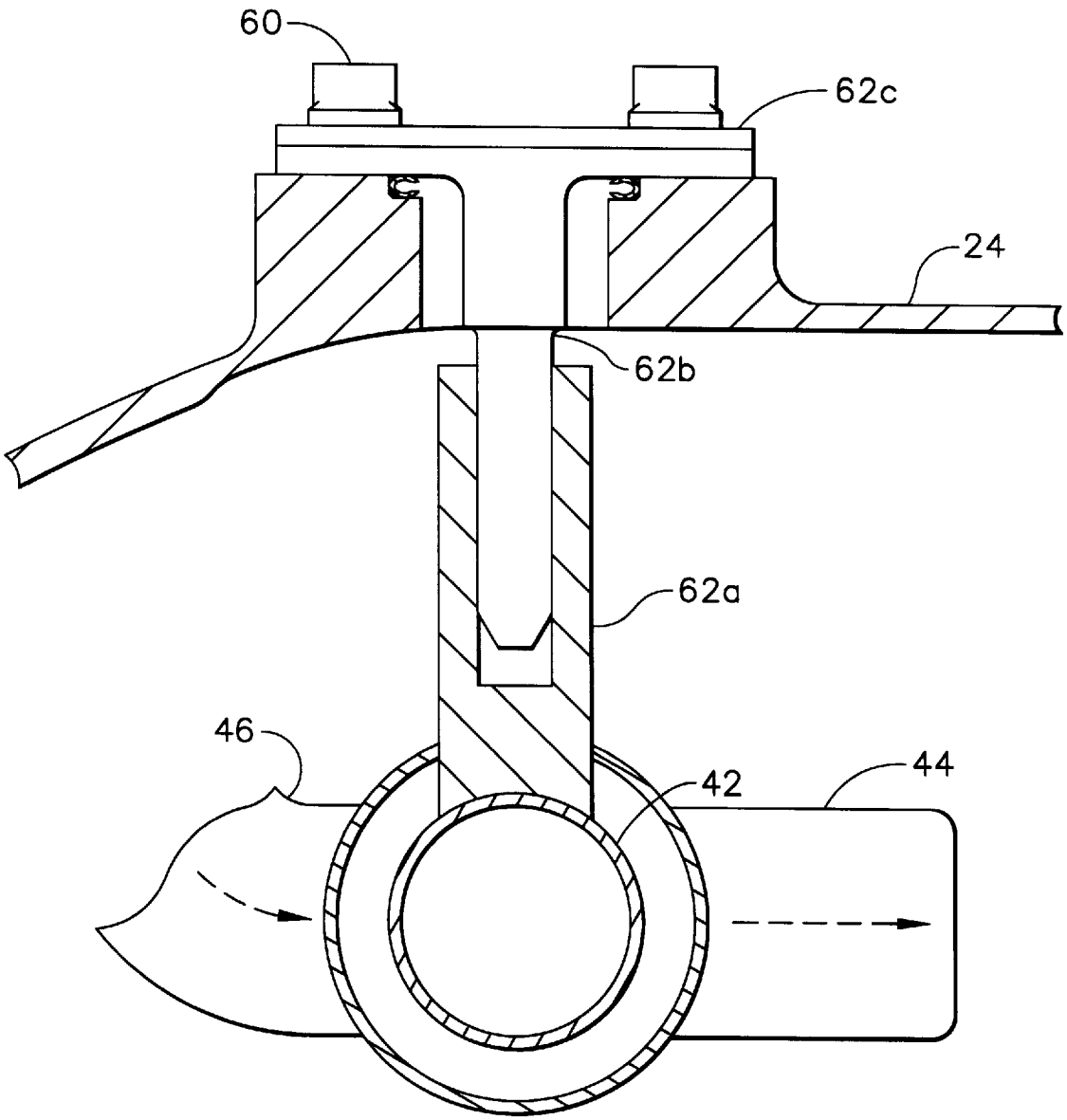
FIG. 7 is an enlarged, sectional view of a mounting arrangement for the manifold illustrated in FIG. 2 and taken generally along line 7—7 in accordance with an exemplary embodiment of the present invention.

As shown in FIGS. 2 and 7, means are disposed radially between the manifold 42 and the combustor case 24 for supporting the manifold 42 axially, tangentially, and radially while permitting unrestrained differential radial movement therebetween. Since the inlet stems 46 at the respective inner fittings 50 are radially unrestrained due to the cooperating splines described above, it also desirable to support the manifold 42 itself without creating undesirable radial restraint which would cause undesirable thermal strain and stress.

In a preferred embodiment as illustrated in FIGS. 2 and 7, the manifold supporting means include a plurality of circumferentially spaced apart tubular lugs 62*a* integrally extending radially outwardly from the manifold 42, and a respective plurality of pins 62*b* are fixedly mounted to the combustor case 24 and extend radially inwardly in part into respective ones of the lugs 62*a*. As shown in FIG. 7, each of the pins 62*b* is integrally attached to a mounting plate 62*c* which is suitably attached to the combustor case 24 using fasteners or machine screws 60, with each pin 62*b* extending radially inwardly through a corresponding port in the case 24 to radially slidingly engage a complementary bore in the lug 62*a*.

Since the lugs 62*a* and pins 62*b* are generally equally spaced around the circumference of the manifold 42 as illustrated in FIG. 2, they support the manifold 42 axially and radially and prevent torsional movement thereof about the engine centerline axis 12. However, the pins 62*b* are free to slide radially within the lugs 62*a* for allowing unrestrained differential radial movement between the manifold 42 and combustor case 24 during operation. In this way, the manifold 42 is rigidly and accurately positioned in space adjacent to the combustor dome 20*c* for accurately positioning the respective fuel injectors 44 in their respective swirlers 36 for improving both SFC and NOx emissions.

As indicated above, with respect to FIGS. 1 and 3, a substantial pressure drop exists across the combustor case 24 due to the difference in pressure between the compressor discharge air 26 and the fan bypass air 32. Accordingly, suitably means are provided for sealing the adaptor 54 to the combustor case 24 against the differential pressure radially across the combustor case 24. And, additional means are provided for sealing the inner fitting 50 to the adaptor 54 against the differential pressure across the combustor case 24 to thereby prevent leakage of the high pressure compressed air 26 through the mounting port 52 and into the bypass duct 30.

As shown in FIG. 3, the first sealing means for the adaptor 54 preferably include a conventional split C-ring seal 64 mounted in compression between the mounting flange 54*a* and a corresponding counterbore in the combustor case 24. In this way, when the adaptor 54 is fastened in position to the combustor case 24, the ring seal 64 is compressed in its counterbore for providing an effective seal against leakage of the high pressure compressor discharge air 26 from the combustor case 24.

The second sealing means for the inner fitting 50 preferably includes a conventional split piston ring seal 66 mounted in compression between a corresponding groove in the external surface of the shroud 50*a* and the smooth internal surface of the sleeve 54*b*. Both seals 64, 66 are made of a suitable metal for the hot environment of the combustor, with the ring seal 64 sealing the outer surface of the adaptor 54, and the ring seal 66 sealing the inner surface of the adaptor 54 against leakage of the pressurized air 26 therepast. The second ring seal 66 is preferably disposed inside the sleeve 54*b* radially between the mounting flange 54*a* and the sleeve splines 54*c* or allowing the shroud 50*a* to travel longitudinally like a piston within the sleeve 54*b*, with the second ring seal 66 providing effective piston sealing.

If desired, the outer fitting 56 may include a suitable annular groove between the collar 56*b* and the nut 56*d* in which a third split piston ring seal 68 is disposed for engaging the inner bore of the mounting flange 54*a* in compression therewith for effecting a redundant seal through the mounting adaptor 54.

Other sealing arrangements between the inner fittings 50 and combustor case 24 may be used including suitable gaskets or shims placed between the underside of the mounting adaptor flange 54*a* and the combustor case 24.

Significant advantages accrue to the improved internal manifold fuel injection assembly 10 disclosed above. The design is relatively easy to manufacture and assemble. All piece parts of the assembly may be readily made using conventional metal castings and joined together as required by simple welds or brazes. The configuration may be scaled for any size tubing and may readily fit in any size combustor case. The improved design significantly increases the accuracy of position of the individual fuel injectors 44 relative to each other about the common manifold 42 which provides a reference support. Manufacturing stack-up tolerances of assembling individual fuel injectors separately to a combustor case are therefore eliminated, which eliminates the corresponding assembly stack-up tolerances associated therewith. And, the manifold 42 more accurately follows thermal radial movement of the combustor 20 to more accurately inject fuel thereto.

Individual fuel injectors are no longer individually assembled through corresponding mounting ports in the combustor case. Accordingly, substantially fewer holes are required in the combustor case 24 since all of the fuel injectors are instead directly attached to the internal manifold 42 within the combustor case 24 and therefore do not require separate mounting holes therethrough. Only one or two mounting ports 52 are required in the case 24 for providing fuel flow through the corresponding inlet stems 46. This increases the simplicity of the combustor case 24 and reduces stress concentrations therein for enhanced life.

The mounting adaptor 54 with its internal splines 54*c* provides a simple and convenient mechanism for torsionally restraining the inner fittings 50 so that the outer fitting 56 may be tightened thereto without imposing undesirable torsional loads on the ballnoses 50*c* and inlet stems 46 joined to the manifold 42.

The several ring seals 64, 66 and 68 provide various levels of sealing effectiveness to prevent leakage of the high pressure compressor discharge air 26 from the combustor case 24 into the bypass duct 30.

The fuel circuit from the supply conduit 58 to the manifold 42 is effectively leak proof using the standard ballnose joint effected between the ferrule 56*a* and the ballnose 50*c*. In the event, however, of fuel leakage at this joint, the shroud 50*a* provides a secondary fuel leakage seal at the second ring seal 66 since the shroud 50*a* is integrally joined to the bottom of the ballnose 50*c* and provides an impervious barrier between the fuel joint at the ballnose and the sleeve 54*b*. Any leaking fuel from the fuel joint will be directed through the mounting port 52 inside the sleeve 54*b* to outside the combustor case 24 instead of leaking inside the combustor case 24.

As indicated above, all of the improved features associated with the first manifold 42 may also be incorporated in the second manifold 42B illustrated in FIGS. 1 and 2. If desired, both manifolds 42 and 42B could be supplied with fuel from common instead of separate inlet stems 46 if desired.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A gas turbine engine fuel injection assembly comprising:

an annular case;

an annular combustor disposed coaxially inside said combustor case, and having a dome;

an arcuate fuel manifold disposed inside said combustor case adjacent to said dome, and having a plurality of circumferentially spaced apart fuel injectors disposed in flow communication therewith for receiving fuel therefrom for injection through said dome;

an inlet stem having a distal end joined in flow communication with said manifold for channeling fuel thereto, and having an inner fitting at a proximal end thereof disposed at a mounting port in said combustor case;

a mounting adaptor fixedly joined to said combustor case at said mounting port and circumferentially engaging said inner fitting;

means for restraining torsional movement of said inner fitting; and an outer fitting extending in said adaptor and threadingly engaging said inner fitting in flow communication therewith for supplying fuel thereto.

2. An assembly according to claim 1 wherein:

said inner fitting includes a tubular shroud;

said adaptor includes a mounting flange fixedly joined to said combustor case, and an integral tubular sleeve coaxially surrounding said shroud; and said means for restraining includes a first plurality of splines formed on said tubular shroud, and a second plurality of splines formed on said tubular sleeve, said second plurality of splines being complementary with said first plurality of splines for engagement therewith.

3. An assembly according to claim 2 further comprising means disposed radially between said manifold and said combustor case for supporting said manifold axially and radially while permitting unrestrained differential radial movement therebetween.

4. An assembly according to claim 3 further comprising:

first means for sealing said adaptor to said combustor case against differential pressure across said combustor case; and second means for sealing said inner fitting to said adaptor against said differential pressure across said combustor case.

5. An assembly according to claim 4 wherein said inner fitting includes a ballnose sealingly engaging said outer fitting for channeling fuel into said inlet stem, with said shroud being fixedly joined to said ballnose and spaced outwardly therefrom to define an annular slot therearound for receiving a portion of said outer fitting.

6. An assembly according to claim 5 wherein said outer fitting includes a ferrule disposed in flow communication with said ballnose, and a cooperating threaded collar disposed in part in said slot for threadingly joining said outer fitting to said inner fitting at said ballnose.

7. An assembly according to claim 6 wherein said collar includes internal threads, and said ballnose includes external threads engaging said collar internal threads for torsionally joining together said outer and inner fittings.

8. An assembly according to claim 6 wherein:

said first sealing means comprise a first ring seal mounted in compression between said mounting flange and said combustor case; and said second sealing means comprise a second ring seal mounted in compression between said shroud and said sleeve.

9. An assembly accordingly to claim 8 wherein said second ring seal is disposed inside said sleeve between said mounting flange and said sleeve splines.

10. An assembly accordingly to claim 6 wherein said manifold supporting means comprise a plurality of circumferentially spaced apart tubular lugs extending radially outwardly from said manifold; and a plurality of pins fixedly mounted to said combustor case and extending radially inwardly in part into respective ones of said lugs.

* * * * *